US009321271B2

(12) United States Patent
Kanda et al.

(10) Patent No.: US 9,321,271 B2
(45) Date of Patent: Apr. 26, 2016

(54) INK JET PRINTING APPARATUS AND RECOVERY METHOD FOR A PRINT HEAD THEREOF

(75) Inventors: Hidehiko Kanda, Yokohama (JP); Susumu Hirosawa, Tokyo (JP); Yutaka Kano, Yokohama (JP); Kentarou Muro, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 1 day.

(21) Appl. No.: 13/365,366

(22) Filed: Feb. 3, 2012

(65) Prior Publication Data

US 2012/0206522 A1 Aug. 16, 2012

(30) Foreign Application Priority Data

Feb. 10, 2011 (JP) ..... 2011-027196

(51) Int. Cl.
*B41J 29/38* (2006.01)
*B41J 2/165* (2006.01)

(52) U.S. Cl.
CPC ..... *B41J 2/16526* (2013.01); *B41J 2/16547* (2013.01); *B41J 2/16585* (2013.01); *B41J 2002/1657* (2013.01)

(58) Field of Classification Search
CPC .... B41J 29/38; B41J 2/16526; B41J 2/16585; B41J 2/16547; B41J 2002/1657
USPC ..... 347/12, 14, 17
See application file for complete search history.

(56) References Cited

U.S. PATENT DOCUMENTS

| | | | | |
|---|---|---|---|---|
| 6,050,674 | A * | 4/2000 | Hirabayashi et al. | 347/40 |
| 6,193,351 | B1 | 2/2001 | Yaegashi et al. | |
| 6,340,217 | B1 * | 1/2002 | Ebisawa et al. | 347/23 |
| 6,382,765 | B1 | 5/2002 | Kanda et al. | |
| 6,447,095 | B1 | 9/2002 | Kanda et al. | |
| 6,746,096 | B2 | 6/2004 | Sakamoto et al. | |
| 6,789,867 | B2 * | 9/2004 | Takahashi et al. | 347/12 |
| 6,854,826 | B2 | 2/2005 | Kanda et al. | |
| 7,118,190 | B2 | 10/2006 | Sakamoto et al. | |

(Continued)

FOREIGN PATENT DOCUMENTS

| | | |
|---|---|---|
| JP | 2001-063088 A | 3/2001 |
| JP | 2005-053047 A | 3/2005 |

OTHER PUBLICATIONS

Office Action in Japanese Patent Application No. 2011-027196 mailed Oct. 14, 2014.

*Primary Examiner* — Justin Seo
*Assistant Examiner* — Jeremy Delozier
(74) *Attorney, Agent, or Firm* — Fitzpatrick, Cella, Harper & Scinto

(57) ABSTRACT

The invention provides a printing apparatus and a recovery method therefore which can minimize ink consumption in a recovery process for a print head of the apparatus. The invention has a control unit to cause a print head to eject ink from nozzles arrayed on the print head so as to recover ink ejecting function of the nozzles, and a specification unit to specify a set print mode selected from among a plurality of print modes. The print modes define number and position of nozzles in use for printing an image. The control unit executes a first preliminary ejection process before or after printing an image on a print medium. The first preliminary ejection process has selectively ejecting ink from both of the nozzles in use selected by the currently set print mode and the unused nozzles in the vicinity of the nozzles in use.

15 Claims, 15 Drawing Sheets

(56) References Cited

U.S. PATENT DOCUMENTS

| | | | | |
|---|---|---|---|---|
| 7,735,946 | B2 | 6/2010 | Tanaka et al. | |
| 7,819,497 | B2 * | 10/2010 | Konno et al. | 347/19 |
| 7,832,826 | B2 * | 11/2010 | Yoshida et al. | 347/19 |
| 8,113,642 | B2 | 2/2012 | Akiyama et al. | |
| 8,136,908 | B2 | 3/2012 | Tanaka et al. | |
| 2008/0055357 | A1 | 3/2008 | Hamasaki et al. | |
| 2008/0100855 | A1 * | 5/2008 | Yoshida et al. | 358/1.8 |
| 2008/0130030 | A1 * | 6/2008 | Okunishi et al. | 358/1.9 |
| 2008/0143780 | A1 | 6/2008 | Sakamoto et al. | |
| 2008/0218547 | A1 * | 9/2008 | Takamiya et al. | 347/12 |
| 2009/0135226 | A1 | 5/2009 | Sakamoto et al. | |
| 2009/0244161 | A1 | 10/2009 | Yamamoto et al. | |
| 2011/0134185 | A1 | 6/2011 | Yamamoto et al. | |
| 2011/0148965 | A1 | 6/2011 | Taira et al. | |

* cited by examiner

INK JET PRINTING APPARATUS AND RECOVERY METHOD FOR A PRINT HEAD THEREOF

BACKGROUND OF THE INVENTION

1. Field of the Invention

The present invention relates to an ink jet printing apparatus and a recovery method for causing a print head of the ink jet printing apparatus to preliminarily eject ink so as to recover ink ejecting function of the print head.

2. Description of the Related Art

Japanese Patent Laid-Open No. 2001-063088 discloses a technique including activating a timer at the end of printing to monitor the elapsed time, judging whether or not the elapsed time exceeds a predetermined time, and creating a preliminary ejection pattern based on a printing ejection pattern, and performing a preliminary ejection recovery process, which is not for printing but for recovering ink ejecting function. In the technique, ink liquid consumption can be suppressed by selectively determining whether to preliminary eject from all of nozzles or preliminary eject only from unused nozzles, instead of to preliminarily eject a constant amount of ink droplets from all of the nozzles at any time.

As a so-called line-type print head, a print head having a plurality of nozzle chips which are regularly arranged in a zigzag alignment is known. If a recovery process disclosed in the above publication is applied to such the elongated line-type print head, wasteful consumption of ink may increase. In particular, upon consecutively printing to a relatively narrow width sheet at specified time intervals, in the above recovery process disclosed in the publication, preliminary ejection of ink is done at any time from nozzles including nozzles located in a region outside the narrow width sheet, which are unused in the printing.

SUMMARY OF THE INVENTION

The present invention provides an ink jet printing apparatus and a recovery method therefore, which can minimize ink consumption in a recovery process for a print head of the apparatus.

The present invention provides an ink jet printing apparatus including: a control unit configured to cause a print head to eject ink from a plurality of nozzles arrayed on the print head so as to recover ink ejecting function of the plurality of nozzles; and a specification unit configured to specify a currently set print mode selected from among a plurality of print modes, the plurality of print modes defining number and position of at least one nozzle in use for printing, wherein the control unit executes a first preliminary ejection process before or after printing an image on a print medium, the first preliminary ejection process comprising selectively ejecting ink from both of at least one nozzle in use selected by the set print mode from among the plurality of nozzles and at least one unused nozzle located in the vicinity of the at least one nozzle in use.

According to the present invention, ink consumption in a recovery process for an elongated line-type print head can be reduced.

Further features of the present invention will become apparent from the following description of exemplary embodiments (with reference to the attached drawings).

DESCRIPTION OF THE EMBODIMENTS

An embodiment of the present invention will be described below in detail with reference to the attached drawings.

Figure 1:
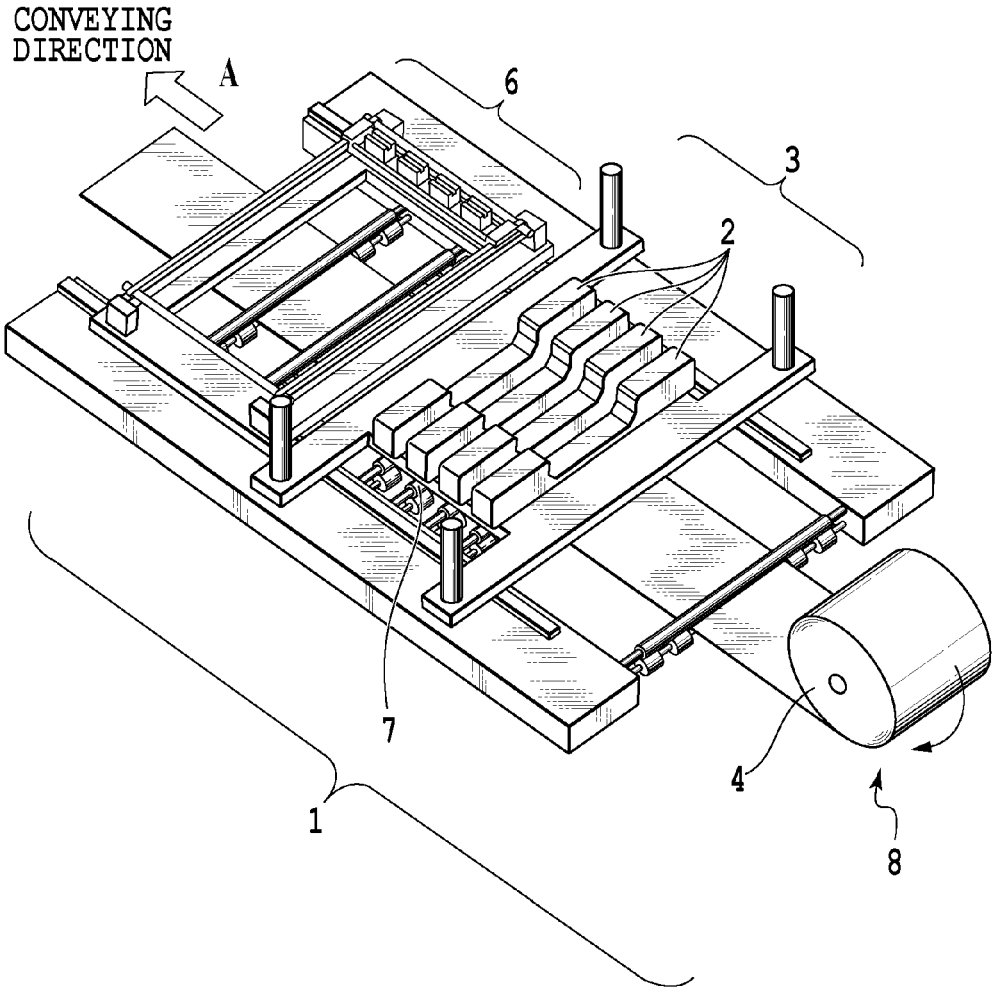
FIG. 1 is a perspective view illustrating a substantial part of a printing apparatus according to an embodiment of the present invention.
Figure 2:
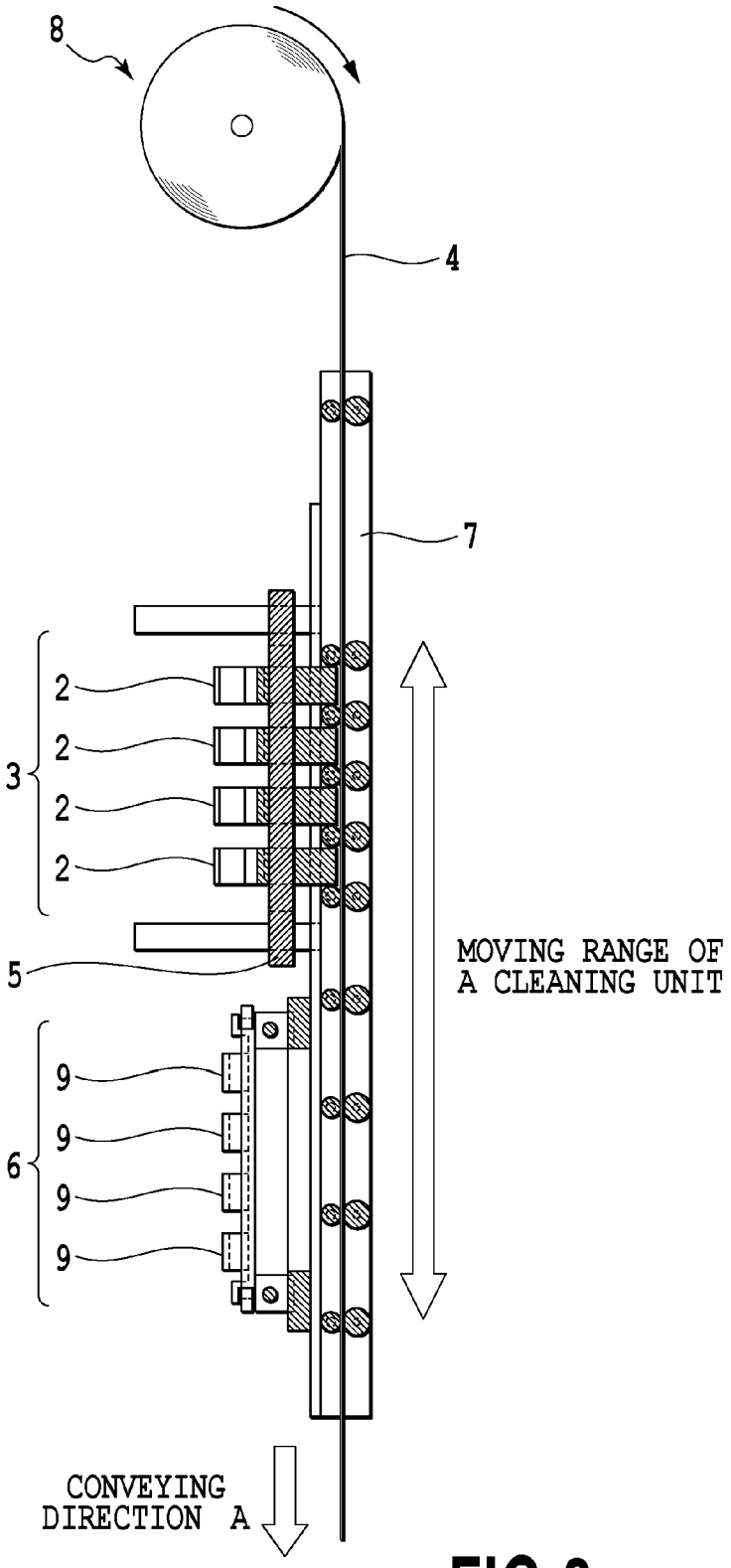
FIG. 2 is a cross-sectional view illustrating the substantial part of the printing apparatus.
Figure 3:
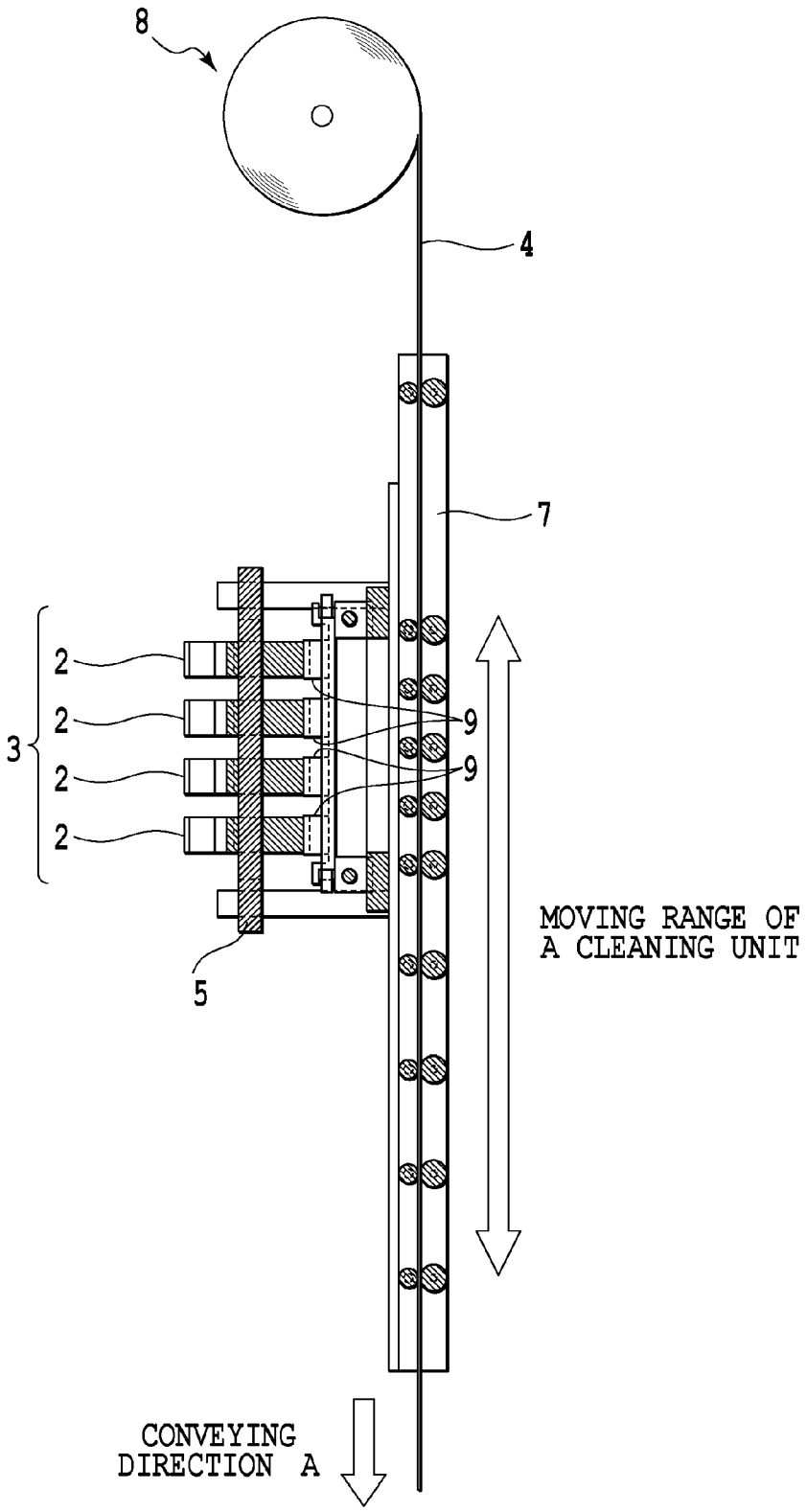
FIG. 3 is a cross-sectional view illustrating the state of a cleaning operation of the printing apparatus.

FIG. 1 is a perspective view illustrating an essential portion centering on a printing unit of a printing apparatus according to an embodiment of the present invention. FIG. 2 is a cross-sectional view of FIG. 1. FIG. 3 is a cross-sectional view illustrating the printing apparatus during a cleaning operation.

The printing apparatus 1 according to the present embodiment is a line printer for printing with a line typed elongated print head while consecutively conveying a print medium in a conveying direction A. The apparatus is provided with a holder 8 for holding a print medium 4 such as continuous roll of sheet, a conveying mechanism 7 for conveying the print medium 4 in the conveying direction A at a predetermined speed and a printing unit 3 for printing on the print medium 4 with a print head 2. Note that the print medium 4 can be not only the continuous roll of sheet but also a cut sheet. In addition, the printing apparatus 1 is provided with a cleaning unit 6 for removing extraneous matter adhered on a nozzle surface of the print head 2, a cutting unit arranged downstream of the printing unit 3 in the conveying direction A and for cutting a print medium 4, drying unit for forcedly drying a print medium, and a discharging tray. The printing unit 3 is provided with a plurality of print the heads 2 corresponding to different colors of ink, respectively. In the present embodiment, the plurality of print heads 2 include four print heads corresponding to four colors of C, M, Y and K, however, the number of colors is not limited to this. Each color ink is supplied to the print heads 2 from an ink tank through an ink tube. The plurality of print heads 2 are integrally held by a head holder 5. The printing apparatus 1 includes a mechanism for moving the head holder 5 up and down so as to change a distance between the plurality of print heads 2 and a surface of a print medium 4, and a mechanism for translating the head holder 5 in a direction intersecting with the conveying direction A.

The cleaning unit 6 has a plurality of (four) cleaning mechanisms 9 corresponding to the plurality of (four) print heads 2. Each cleaning mechanism 9 will be described in detail below. The cleaning unit 6 is slidable in the conveying direction A by a drive motor (not shown). FIGS. 1 and 2 show a state during printing an image, and the cleaning unit 6 is located downstream with respect to the printing unit 3 in the conveying direction A. FIG. 3 shows a cleaning operation state, and the cleaning unit 6 is located immediately below the print heads 2 of the printing unit 3. In FIGS. 2 and 3, a movable range of the cleaning unit 6 is indicated by an arrow.

Figure 4A:
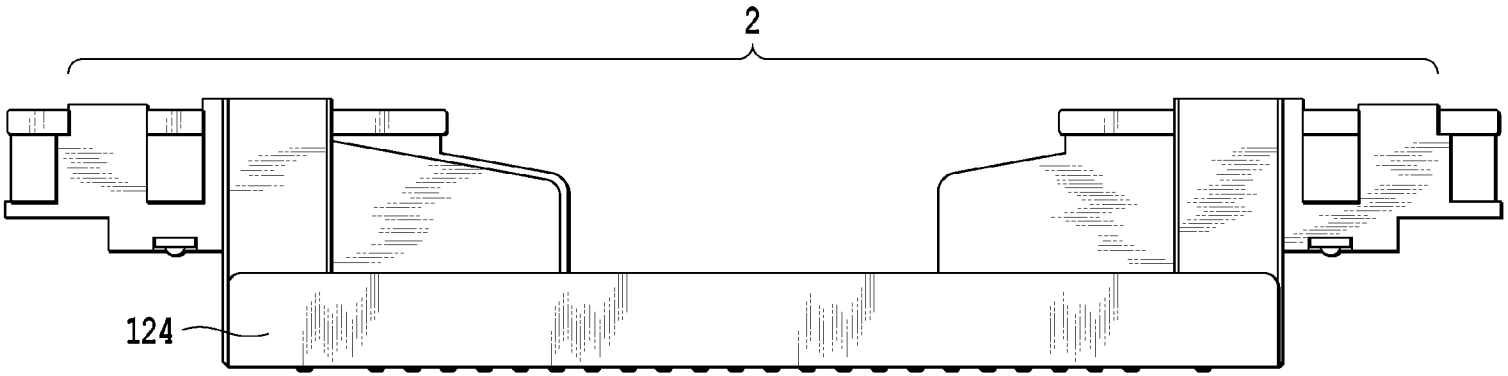
FIGS. 4A and 4B are views illustrating an example of a structure of a print head to which the present invention is applied.
Figure 4B:
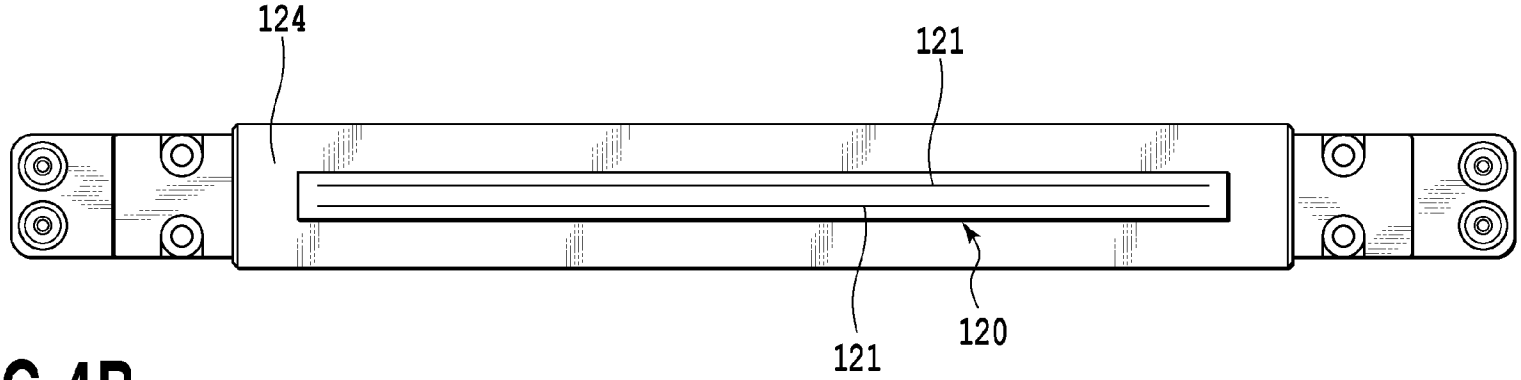

FIGS. 4A and 4B illustrate a structure of the single print head 2. Any of a technique using a heating element, a technique using a piezoelectric element, a technique using a MEMS element, a technique using an electrostatic element, etc. is applicable as the inkjet technique. The print head 2 is a line type print head on which ink jet nozzle arrays are formed within a range for covering a maximum width of an applicable print medium. An arrangement direction of nozzles is a direction intersecting with the conveying direction A, for example a direction perpendicular to the conveying direction A. On a base substrate 124, a single nozzle chip 120 is disposed along a longitudinal direction. The nozzle chip 120 has a plurality of nozzle arrays 121 which are formed by a plurality of arrayed nozzles, respectively, as shown in FIG. 4B.

Figure 5:
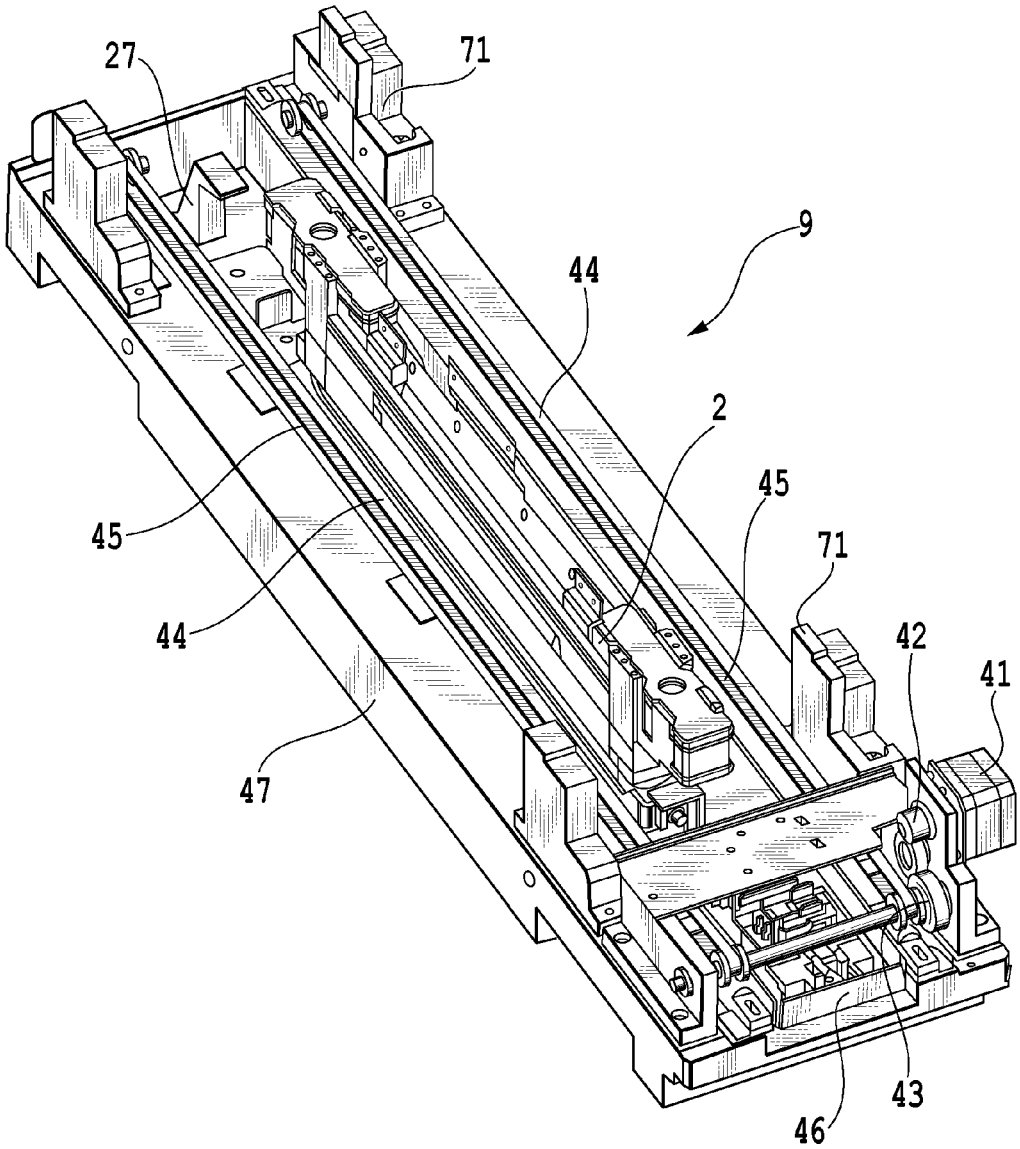
FIG. 5 is a perspective view illustrating an arrangement of a cleaning mechanism.
Figure 6:
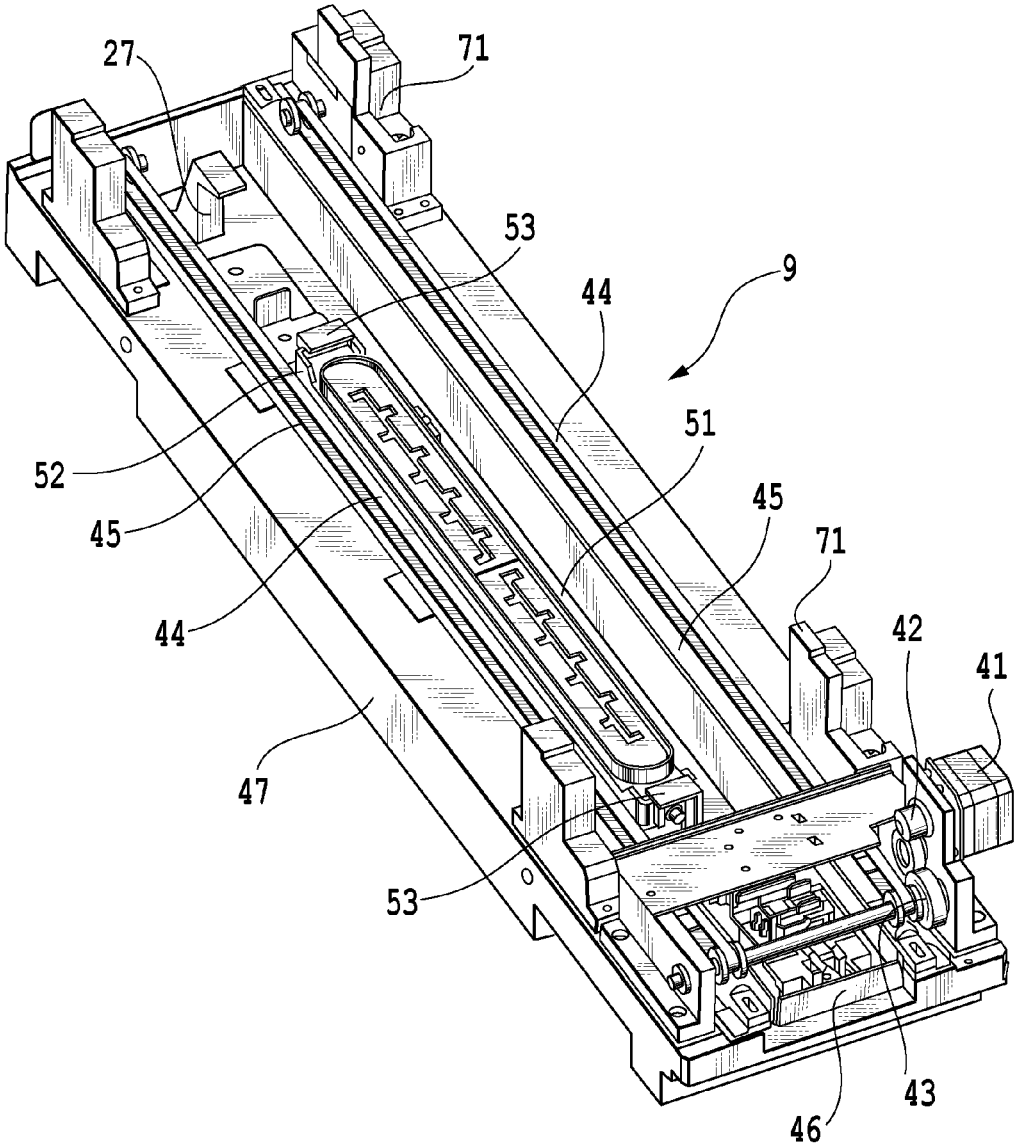
FIG. 6 is a perspective view illustrating an arrangement of the cleaning mechanism of FIG. 5.

FIGS. 5 and 6 are perspective views illustrating a detail arrangement of the cleaning unit 6 and the single cleaning mechanism 9. FIG. 5 shows a state where the print heads are located on the cleaning mechanism (a cleaning operation state). FIG. 6 shows a state where the print heads are not located on the cleaning mechanism. In the cleaning unit 6, the cleaning mechanism 9, a caps 51 and positioning members 71 are provided. The cleaning mechanism 9 has a wiping unit 46 for removing extraneous matter adhered on the nozzle surface of the print head 2, a moving mechanism for moving the wiping unit 46 along the wiping direction (the nozzle array direction), and a frame 47 for integrally supporting them. The moving mechanism is driven by a drive source and moves the wiping unit 60 guided and supported by two shafts 45 in the nozzle array direction. The driving source has a driving motor 41 and reduction gears 42 and 43, to rotate the drive shaft 37. Rotation of the drive shaft 37 is transmitted through a belt 46 and a pulley to the wiping unit 46 so that the wiping unit 46 is moved. In FIG. 6, the cap 51 is held by a cap holder 52. The cap holder 52 is biased to the nozzle surface of the print head 2 in a vertical direction to the surface with a spring and is movable against an elastic force of the spring. When the frame 47 is positioned at a cap position, translation of the print head 2 in the vertical directions to the nozzle surface provides its engagement and disengagement with the cap 51. The print head 2 is closely contacted with the cap so as to cap the nozzle surface, so that drying of the nozzles can be reduced. In addition, ejected ink droplets in preliminary ejection for removing thickened ink liquid in the nozzles are collected by the cap 51. During the cleaning and capping operations, the positioning members 71 contact with head positioning members arranged on the head holder 5 in three directions of the conveying direction A, the nozzle array direction and the vertical direction to the nozzle surface, so that positional relationship between the print head 2 and the cleaning unit 6 is defined.

Figure 7:
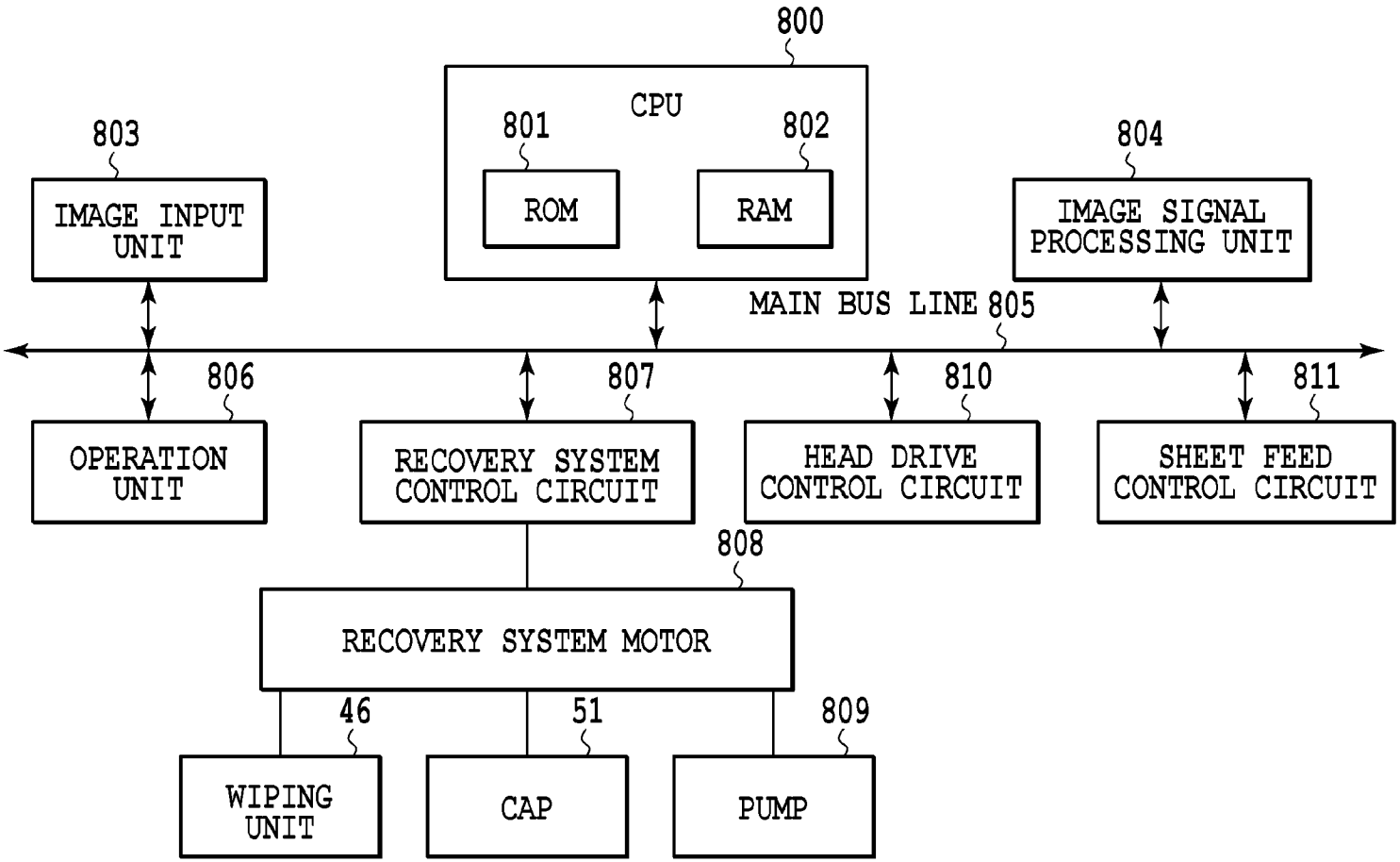
FIG. 7 is a block diagram illustrating a control system of a printing apparatus of present invention.

FIG. 7 is a block diagram illustrating a control system of the ink jet printing apparatus according to the present invention. In FIG. 7, the control system is roughly classified into a software processing system such as an image input unit 803, an image signal processing unit 804 corresponding to the image input unit 803 and a CPU 800, and a hardware processing system such as an operation unit 806, a recovery system control circuit 807, a head drive control circuit 810 and a sheet feed control circuit 811. The software and hardware processing systems access to a main bus line 805, respectively. The CPU 800 generally has a read only memory (ROM) 801 and a random access memory (RAM) 802, provides an appropriate printing condition with respect to input information and drives the print head 2 so as to print. In the RAM 802, a program for executing a recovery process for the print head 2 is stored, a recovery condition such as a preliminary ejection condition into the cap 51 is provided to the recovery system control circuit 807 and the print head 2. A recovery system motor 808 drives the aforementioned print head 2, the wiping unit 46 facing and spaced to the print head 2, the cap 51 and a suction pump 811 for suctioning ink ejected into the cap 51. The head driving control circuit 810 executes a preliminary ejection control and an ink ejection control for printing in the print head 2 according to a drive condition for an electrothermal converter for ink ejection of the print head 2.

First Embodiment

The print head 2 of the present embodiment is an elongated head formed by a single nozzle chip 120, and creates a printed image on a print medium up to 10 inch width size. A volume of ink droplets ejected from a nozzle is 10 pl (picoliters). A maximum head drive frequency for stably ejecting these ink droplets is set to 3 KHz. In the present embodiment, image data with a resolution of 600×600 dpi is printed while a continuous roll of print medium 4 is conveyed at 5 inches per second in the conveying direction A.

Figure 8:
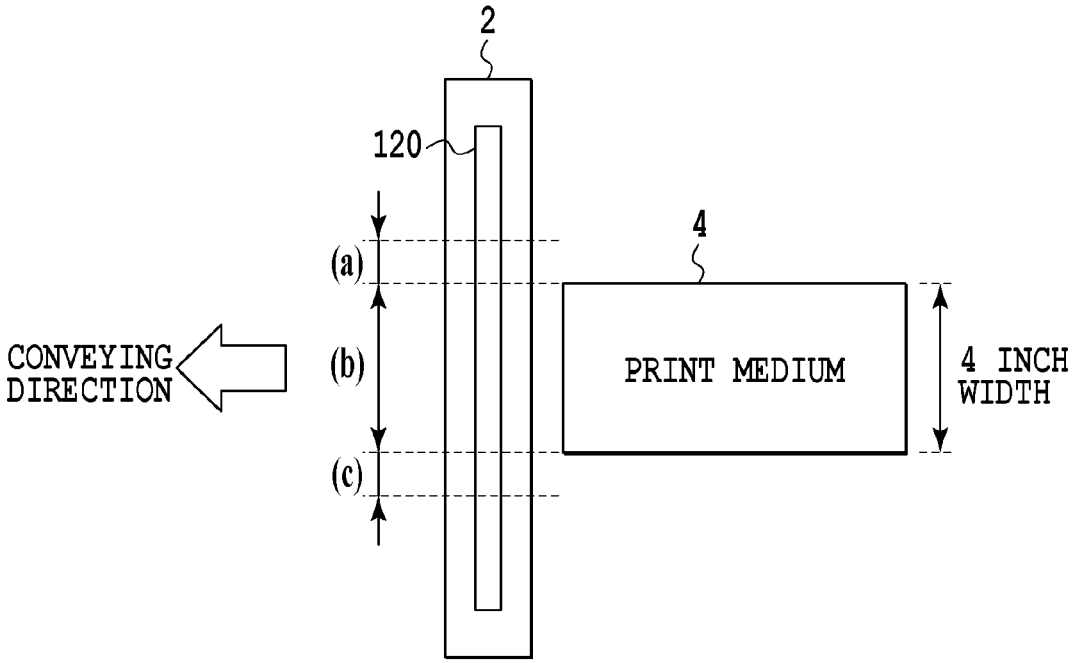
FIG. 8 is a view illustrating a positional relationship of available nozzles in the print head with respect to a 4 inch width print medium used in the first embodiment of the present invention.
Figure 9:
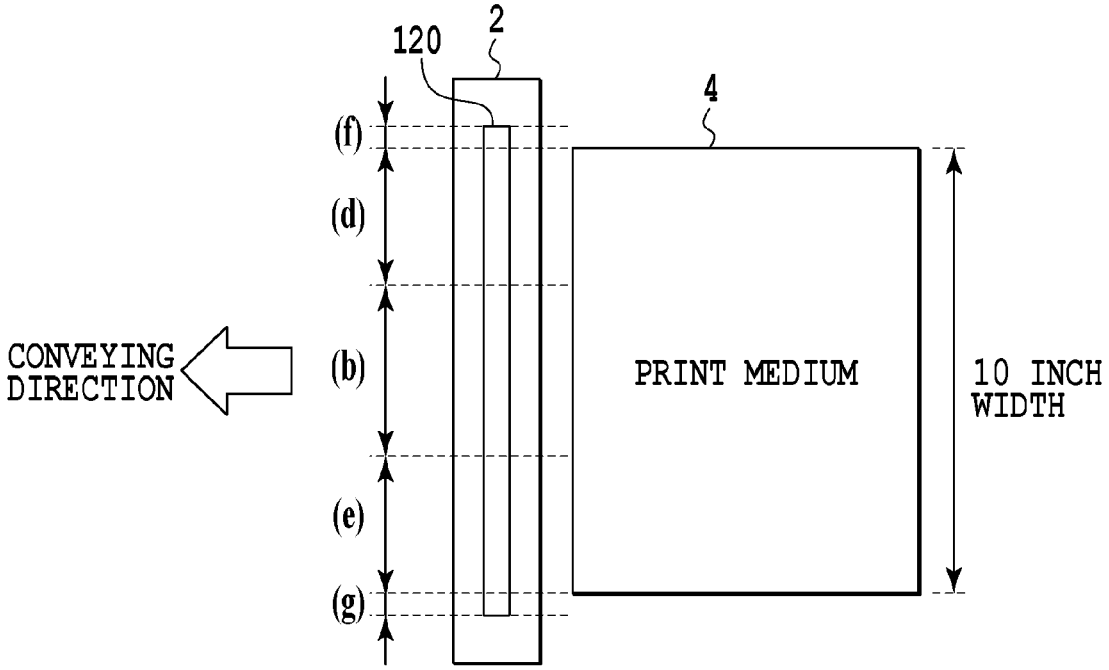
FIG. 9 is a view illustrating a positional relationship of available nozzles in a print head with respect to a 10 inch width print medium used in the first embodiment of the present invention.

In the present embodiment, an explanation will be made with reference to FIG. 10 in case where a currently set printing mode is changed from a printing mode for repeatedly printing on a 4 inch width of print medium as shown in FIG. 8 to a printing mode for printing on a 10 inch width of print medium as shown in FIG. 9.

Figure 10:
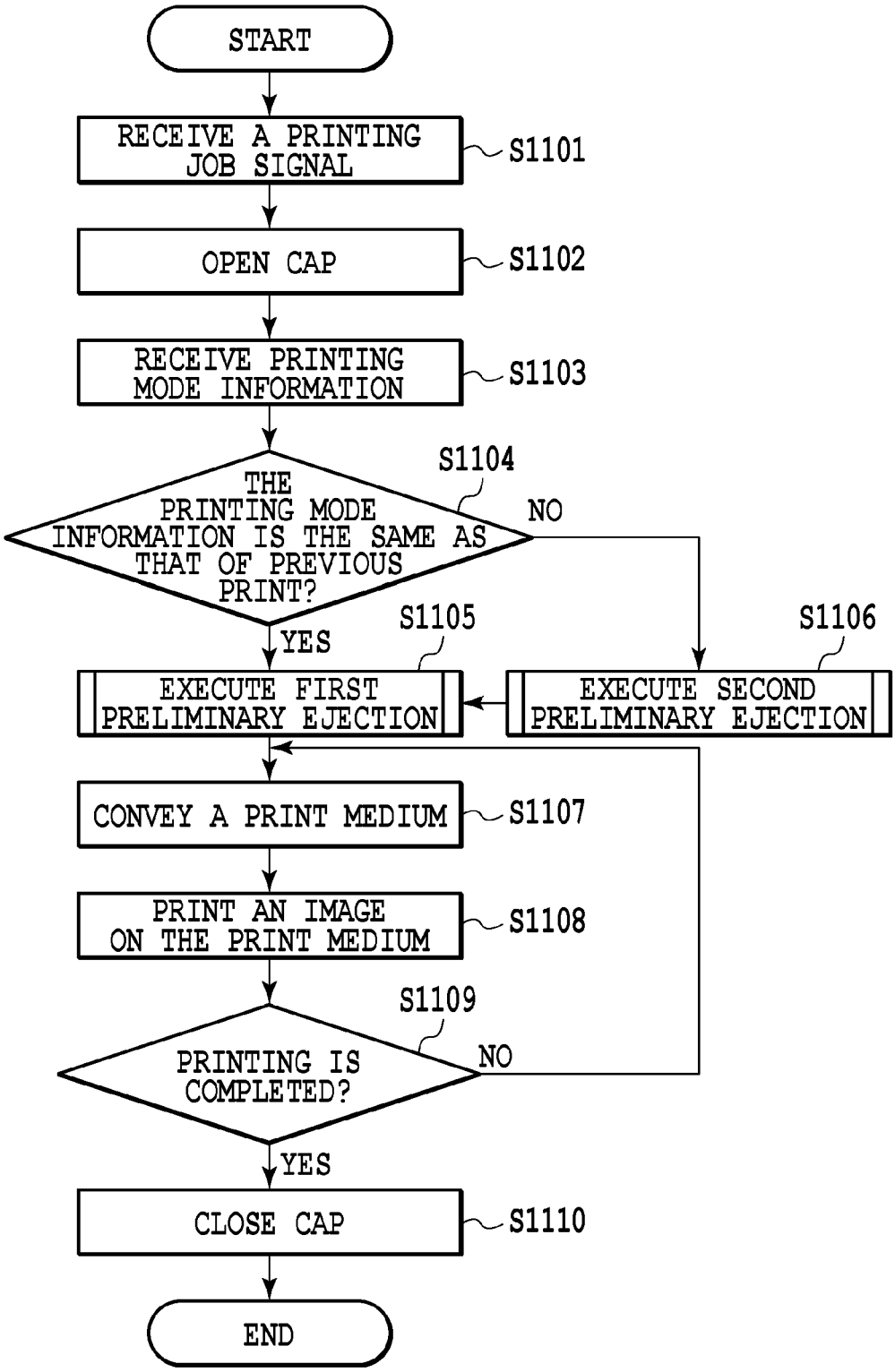
FIG. 10 is a flow chart illustrating a recovery process according to a first embodiment of the present invention.

FIG. 10 is a flow chart illustrating a recovery process of the present embodiment. The CPU 800 implements the process shown in FIG. 10.

First, when a printing job signal is received in S1101, the cap 51 is opened in S1102. Next, print mode information for printing from now is received in S1103. The print modes are defined depending on the number and position of nozzles in use for printing an image. A plurality of printing modes exists. For example, when the printing apparatus is set to the print mode of FIG. 8, information of "print medium size is 4 inch width" is received. In FIG. 8, the print medium should be located at a middle position in the nozzle array direction. When the print medium size is recognized, the number and position of the nozzles in use for printing an image can be determined. Note that the print mode information can be any information for which specifies the number and position of the nozzles in use.

Next, in S1104, the information of the received print mode is compared with the print mode information for the last time printing to judge whether they are the same or not. That is, it is detected whether or not the print mode is changed. In the judgment, when the print mode is not changed, that is, the judgment is "YES", first preliminary ejection is implemented to recover the ink ejection function of the nozzles.

In the first preliminary ejection of the present embodiment, ink is selectively ejected from nozzles in use selected by the currently set print mode (the print mode specified in S1104) from among the plurality of nozzles formed on the nozzle chip 120 and unused nozzles located in the vicinity of the nozzles in use. Specifically, ink is preliminarily ejected from the nozzles in a region (b) in FIG. 8 (the nozzles in use) and the nozzles in regions (a) and (c) in FIG. 8 (the unused nozzles). In the first preliminary ejection, the number of ink droplets ejected from the respective ink ejecting nozzles is, for example, one hundred. The first preliminary ejection recovery process discharges thickened ink, which has been thickened while the cap is closed, into the cap 51.

Next, while conveying a print medium at a conveying speed of 5 inches per second in S1107, an image is printed on the conveyed print medium with 4 inch width in 1108. In S1109, it is judged whether or not the printing on the print medium is completed. When the judgment is "No", it is ongoingly done to convey the print medium in S1107 and to print an image in S1108. When the judgment is "Yes", in S1110, a cap closing action with the cap 51 is done to reduce ink drying in the nozzles of the print head.

When the same print mode as FIG. 8 is repeated, preliminary ejection of ink from nozzles located in the regions except the regions (a) to (c) is not performed, so that wasteful ink consumption can be reduced.

Next, a process will be described in case where the currently set print mode is changed from a print mode for printing on a 4 inch width of print medium as shown in FIG. 8 to a print mode for printing on a 10 inch width of print medium as shown in FIG. 9. When the currently set printing mode is changed from the printing mode of FIG. 8 to the printing mode of FIG. 10, in S1103 of the flow chart of FIG. 9, as the changed print mode information, for example, information of "the size of the print medium is 10 inch width" is received. In S1104, a judgment whether or not the currently set print mode is the same as the print mode for the last time printing will result in "No", so that a second preliminary ejection is implemented in S1106.

In the second preliminary ejection process according to the present embodiment, when the print mode is changed, before printing an image on a print medium, ink is ejected selectively from newly selected nozzles in use from among unused nozzles and nozzles located in the vicinity of the newly selected nozzles in use. Specifically, the nozzles in the regions (d) and (e) in FIG. 9 are the newly selected nozzles in use from among the unused nozzles, and the nozzles in the regions (f) and (g) are the nozzles located in the vicinity of the newly selected nozzles in use. The nozzles in the region (b) in FIG. 9 are the same as the nozzles in the region (b) FIG. 8, which is already nozzles in use. In the preliminary ejection process, the number of ink droplets ejected from the respective ink ejecting nozzles is, for example, five hundred. The number is preferably greater than that in the first preliminary ejection. The second preliminary ejection recovery process discharges thickened ink in the nozzles into the cap 51 when the cap is opened.

Next, in S1105, following this, the above first preliminary ejection process is implemented. The first preliminary ejection process discharges ink in the nozzles, which has been thickened while the cap is closed, into the cap 51. In the print mode shown in FIG. 9, ink is preliminarily ejected from all of the nozzles in the regions (b), (d), (e), (f) and (g).

As seen from the above, in the second preliminary ejection operation, ink is preliminarily ejected from the nozzles which are changed from the unused nozzles to the nozzles in use, so that wasteful ink consumption can be reduced in comparison with the case of preliminarily ejecting ink from all nozzles which are used in the currently set print mode. In addition, in the second preliminary ejection operation, ink is ejected also from the nozzles in the vicinity of the newly selected nozzles in use, so that image degradation due to thickening of ink in the unused nozzles in the vicinity of the boundary between the nozzles in use and the unused nozzles can be prevented.

Second Embodiment

In the first embodiment, an explanation was made in the case where the elongated print head is formed by the single nozzle chip 120. In the present embodiment, an explanation will be made in case of using a print head which is provided with a plurality of nozzle chips, as shown in FIGS. 11A and 11B.

Figure 11A:
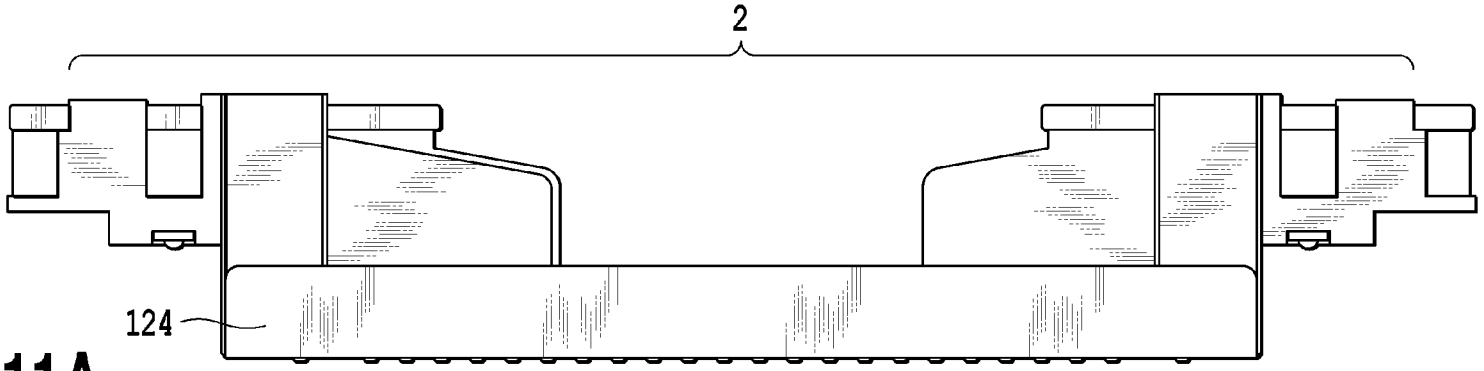
FIGS. 11A and 11B are views illustrating another example of a structure of the print head to which the present invention is applied.
Figure 11B:
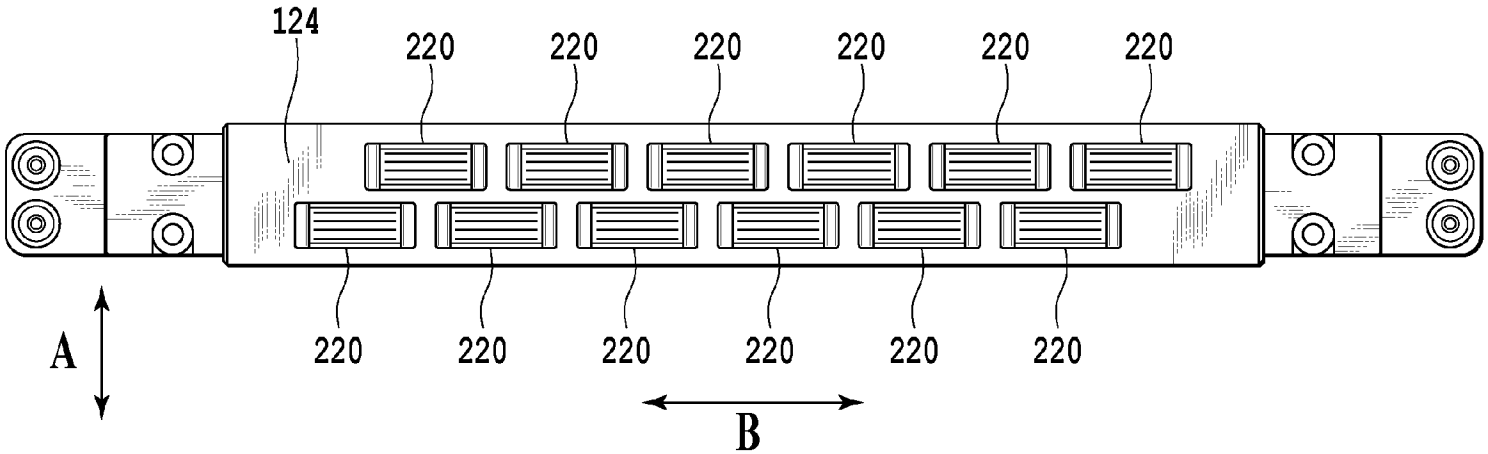

The print head 2 shown in FIGS. 11A and 11B, is a line type print head on which ink jet nozzle arrays are formed within a region covering a maximum width of an applicable print medium. The nozzle array direction is a direction intersecting with a conveying direction of a print medium, for example, a direction B perpendicular to the conveying direction. A plurality of (twelve in the present embodiment) nozzle chips 220 having the same size and structure are regularly arranged in two rows and in a zigzag alignment on a base substrate 124, as illustrated in FIGS. 11A and B.

Figure 12:
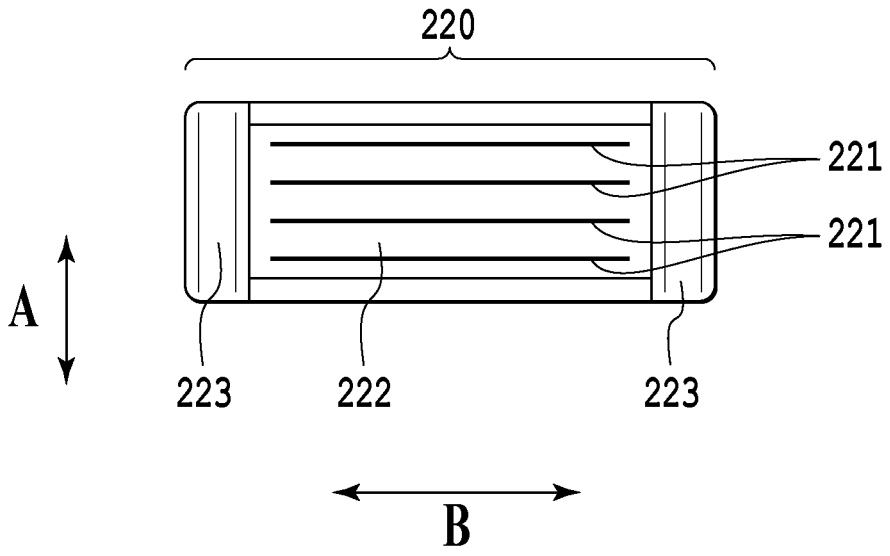
FIG. 12 is a view illustrating a structure of a nozzle chip in the print head.

FIG. 12 is a view showing a structure of the nozzle chip 220 forming the print head 2. The nozzle chip 220 is provided with a nozzle surface 222, on which a plurality of nozzle arrays 221 having a plurality arrayed nozzles for ejecting ink are formed, and a nozzle substrate, in which energy elements formed corresponding to the respective nozzles are embedded. The plurality of (four in the present embodiment) nozzle arrays 221 are arranged in parallel with each other and at regular intervals in the conveying direction A. The respective nozzle arrays 221 have 960 nozzles arranged at intervals of 600 dot per inch (dpi) and have a length of 1.6 inches. The nozzle substrate for the nozzle chips 220 is installed on the base substrate 224. The nozzle substrate and the base substrate 224 are connected to each other with an electrical connection. The electrical connection is coated with a sealing portion 223 formed of a resin material so as to be protected from erosion and disconnection.

Figure 13:
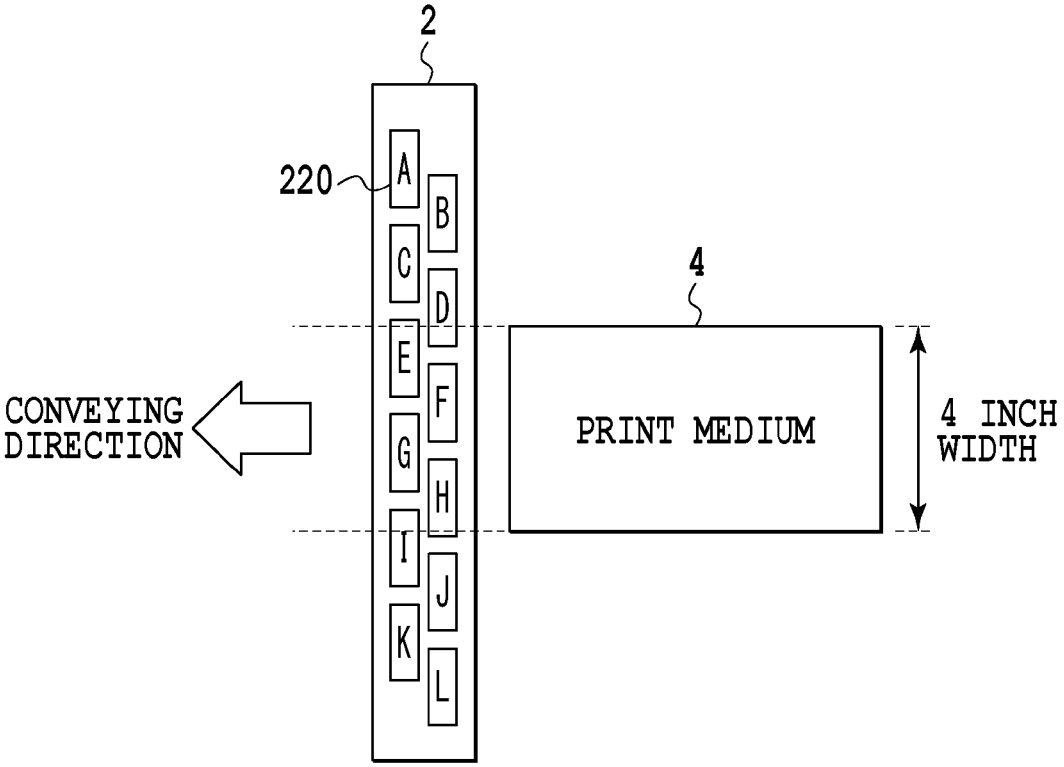
FIG. 13 is a view illustrating a positional relationship of available nozzles in the print head with respect to a 4 inch width print medium in a second embodiment of the present invention.
Figure 14:
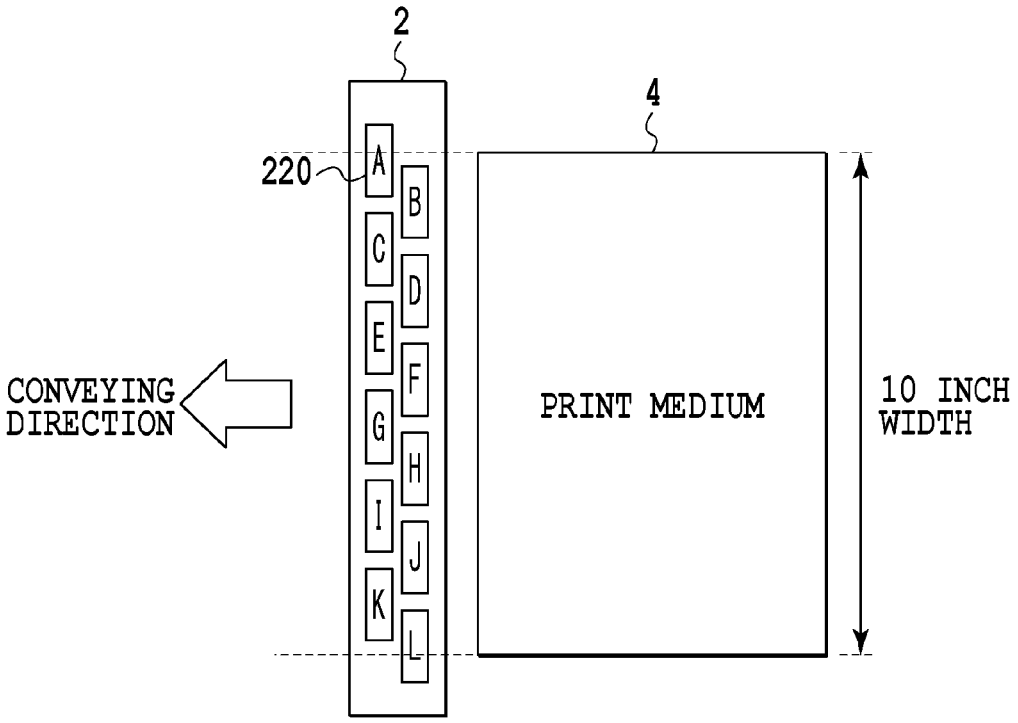
FIG. 14 is a view illustrating a positional relationship of available nozzles in the print head with respect to a 10 inch width print medium used in the second embodiment of the present invention.

Next, a recovery process using the above print head will be described. Note that the basic process of the second embodiment is similar to that of the first embodiment, so the second embodiment will be explained with reference to the flow chart of FIG. 10. FIG. 13 is a view showing a print mode for printing on a 4 inch width size print medium. FIG. 14 is a view showing a print mode for printing a 10 inch width size print medium. A to L assigned to the respective nozzle chips 220 in FIGS. 13 and 14 correspond to the twelve nozzle chips 120 shown in FIG. 11B.

When the print mode information received in S1103 is judged as the printing mode shown in FIG. 13 and is judged as the same print mode information as the last time printing, ink is preliminarily ejected from all of the nozzles in the respective nozzle chips 220 including the nozzles in use in the currently set print mode among the plurality of nozzle chips 220, to implement the above first preliminary ejection process. Specifically, the nozzle chips 220 including the available nozzles in the print mode shown in FIG. 13 are the six nozzle chips 220 of D, E, F, G, H and I, and ink is preliminarily ejected from all of these six nozzle chips 220. As seen from the above, when the same print mode shown in FIG. 13 is repeated, it is unnecessary to implement preliminary ejection for the six nozzle chips A, B, C, J, K and L which are not used in the printing, so that wasteful ink consumption can be reduced.

Next, when the currently set print mode is changed from the print mode shown in FIG. 13 to the print mode shown in FIG. 14, a change of the print mode is detected in S1104. And, in S1106, ink is preliminarily ejected from all of the nozzles in the respective nozzle chips 220 including the newly selected nozzles in use from among the unused nozzles in the currently set print mode to implement the above second preliminary ejection process. Specifically, ink is preliminarily ejected from all of the nozzles in the six nozzle chips 220 of A, B, C, J, K and L.

Next, in S1105, following the second preliminary ejection process, the first preliminary ejection process is implemented. The first preliminary ejection process of the present embodiment causes all of the nozzles in the nozzle chips including the nozzles in use in the print mode shown in FIG. 14. The first preliminary ejection recovery process discharges ink, which has been thickened in the nozzles while the cap is closed, into the cap 51. In the print mode of FIG. 14, the twelve nozzle chips 220 of A to L are used for the first preliminary ejection.

As seen from the above, the second preliminary ejection is performed only when the currently set print mode is switched from the print mode of FIG. 13 to the print mode of FIG. 14, so that wasteful ink consumption can be reduced. In addition, the second preliminary ejection is performed only for the nozzle chip(s) which is (are) switched from an unused nozzle chip to a chip in use. Accordingly, it is unnecessary to perform the second preliminary ejection for the six nozzle chips of D, E, F, G, H and I, which have been used up to now. As a result, wasteful ink consumption can be further reduced. Furthermore, in the first preliminary ejection operation, ink is preliminarily ejected from all of the nozzles in the nozzle chip including the nozzles in use, to avoid thickened ink from being ejected from unused nozzles in the vicinity of the boundary between the nozzles in use and the unused nozzles. As the result, image degradation can be prevented.

Third Embodiment

In the first and second embodiments, an explanation was made in the case where the currently set print mode is changed depending on the size of a print medium. In the present embodiment, an explanation will be made in case where the currently set print mode is changed depending on a change of position of the nozzles in use in the plurality of nozzles of the print head. Note that the basic process of the third embodiment is similar to the process of the first embodiment, so the third embodiment will be explained with reference to the flow chart of FIG. 10.

Figure 15:
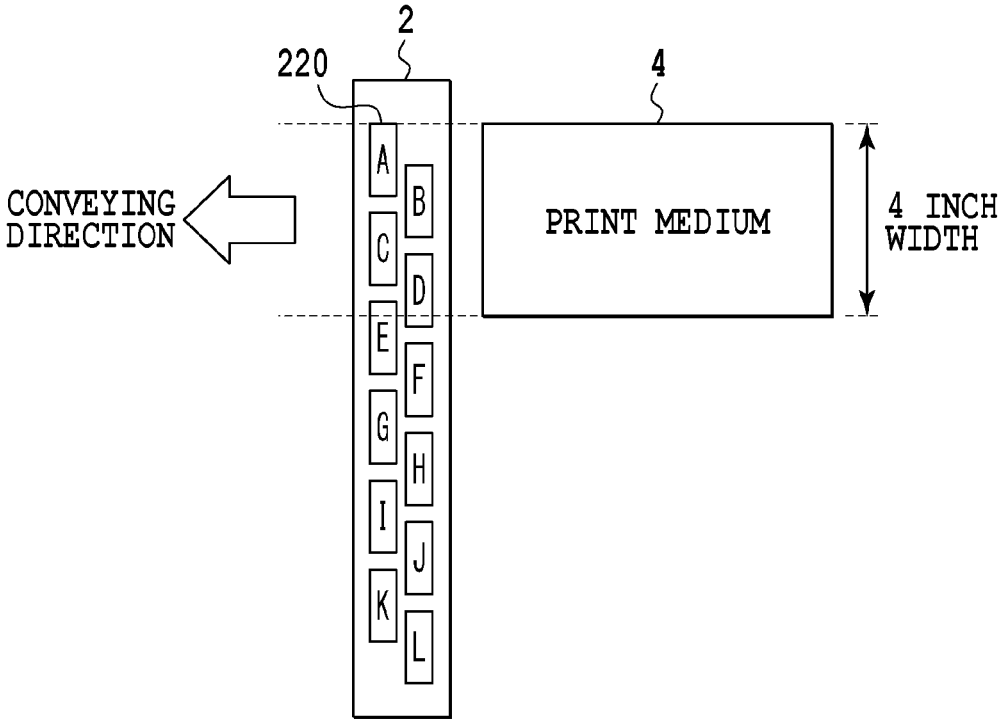
FIG. 15 is a view illustrating a positional relationship of available nozzles in the print head with respect to a 10 inch width print medium used in a third embodiment of the present invention.

In the present embodiment, for example, under a given print mode such as the print mode shown in FIG. 13, the number of ejected ink droplets from the respective nozzles of the respective nozzle chips in the print head 2 is counted. When the counted number of ejected ink droplets exceeds a predetermined number of ejected ink droplets, the currently set print mode is changed to a print mode for printing with a nozzle chip including a nozzle of the least number of ejected ink droplets. For example, when the nozzle chip 220 including the nozzle of the least number of ejected ink droplets is located at a position of A, an image is printed while the print head is moved relatively to the print medium as illustrated in FIG. 15. In this way, the position of the same number of nozzles in use is appropriately changed, so that durability life of the print head can be extended. Note that the detail description of a mechanism for changing a relative position between the print head and the print medium will be omitted.

Specifically, when the print mode of FIG. 13 is repeated, in S1105, the preliminary ejection from the six nozzle chips 220 of D, E, F, G, H and I is done. And when the currently set print mode is changed the print mode of FIG. 13 to the print mode of FIG. 15, in S1104, a change of the currently set print mode is detected, and then the second preliminary ejection process is implemented in S1106. At this time, nozzle chips 220 used in the print mode of FIG. 15 are the nozzle chips 220 located at positions of A to E, and nozzle chips 220 which include newly selected nozzles in use are the three nozzle chips located at positions of A to C.

Next, in S1105, following the second preliminary ejection process, the first preliminary ejection process is implemented. In the first preliminary ejection process according to the present embodiment, ink is preliminarily ejected from all of the nozzles in the respective nozzle chips 220 located at positions of A to E shown in FIG. 15.

As seen from the above, in the second preliminary ejection process of the present embodiment, it is unnecessary to perform preliminary ejection of ink from the three nozzle chips D, E and F which have been used up to now, so that wasteful ink consumption can be reduced.

The Other Embodiment

In the third embodiment, a line type print head having a plurality of nozzle chips arranged in a zigzag alignment was employed, however, of course the third embodiment is also applicable to the single nozzle chip shown in FIG. 4.

In the above embodiment, the first preliminary ejection is executed only when starting printing, however, it is not limited to this timing. Immediately before closing the cap in S1110 of FIG. 10, the first preliminary ejection can be performed for all of the nozzles including nozzles used for printing to discharge thickened ink from nozzles in use to which no image data was provided.

In the above embodiment, there is no description about preliminary ejection during printing an image on a print medium, however, during printing, ink can be preliminarily ejected from only nozzles in use not from all of the nozzles in a nozzle chip including the nozzles in use as a third preliminary ejection process. As a result, ink mists caused by ejection can be suppressed.

In case where a recovery process for removing bubbles in nozzles, filling ink into nozzles or removing extraneous matter adhered on a nozzle surface is already done and thickened ink in the nozzles is already removed before starting printing, it is unnecessary to perform the first and second preliminary ejection in S1105 and S1106 of FIG. 10.

The number of ejected ink droplets in the first and second preliminary ejection process of the present invention is not limited the above number. The number can be selected depending on ink type, ink color, alignment of a print head, nozzle diameter, cap closing elapsed time, cap opening elapsed time, etc. . . .

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-027196, filed Feb. 10, 2011, which is hereby incorporated by reference herein in its entirety.

What is claimed is:

1. An ink jet printing apparatus comprising:

a conveying unit configured to convey a print medium in a first direction;

a print head having a plurality of nozzles for ejecting ink which are arrayed in a second direction intersecting with the first direction; and a preliminary ejection unit configured to cause the print head to eject ink from a plurality of nozzles so as to perform a preliminary ejection operation, wherein in a case where a range of nozzles of the print head to be used in a subsequent print operation is included in a range of nozzles of the print head used in a previous print operation, the preliminary ejection unit causes the print head to perform a first preliminary ejection operation in which ink is ejected from the nozzles to be used in the subsequent print operation, and in a case where the range of nozzles of the print head to be used in the subsequent print operation exceeds the range of nozzles of the print head used in the previous print operation, the preliminary ejection unit causes the print head to perform a second preliminary ejection operation in which ink is ejected from nozzles that will be newly used in the subsequent print operation, the amount of the ink ejected from each of the nozzles in the second preliminary ejection operation being greater than the amount of the ink ejected from each of the nozzles in the first preliminary ejection operation.

2. The ink jet printing apparatus of claim 1, further comprising a detecting unit configured to detect whether the range of nozzles to be used in the subsequent print operation is changed from the range of nozzles used in the previous print operation, wherein in accordance with a detected result by the detecting unit, the preliminary ejection unit causes the print head to perform the first preliminary ejection operation or the second preliminary ejection operation.

3. The ink jet printing apparatus of claim 2, wherein the print head comprises a plurality of nozzle chips with a plurality of nozzle arrays, and the first preliminary ejection operation caused by the preliminary ejection unit comprises ejecting ink from all of nozzles in each of at least one nozzle chip that includes at least one nozzle which was used in the previous print operation.

4. The ink jet printing apparatus of claim 2, wherein before the subsequent print operation, the preliminary ejection unit causes the print head to perform the first preliminary ejection operation after causing the print head to perform the second preliminary ejection operation.

5. The ink jet printing apparatus of claim 2, wherein the print head comprises a plurality of nozzle chips with a plurality of nozzle arrays, and the second preliminary ejection operation caused by the preliminary ejection unit comprises ejecting ink from all of nozzles in each of at least one nozzle chip which includes at least one nozzle that will be newly used in the subsequent print operation.

6. The ink jet printing apparatus of claim 1, wherein the range of nozzles to be used in the subsequent print operation is changed from the range of nozzles using the previous print operation depending on a print medium size.

7. The ink jet printing apparatus of claim 1, wherein a position of the range of nozzles to be used in the subsequent print operation is changed in the second direction from the range of nozzles used in the previous print operation.

8. The ink jet printing apparatus of claim 1, wherein the preliminary ejection unit causes the print head to perform a third preliminary ejection operation while printing an image, the third preliminary ejection operation comprising ejecting ink only from at least one nozzle used in printing an image.

9. The ink jet printing apparatus of claim 1, wherein in the first preliminary ejection operation, ink is also ejected from nozzles located in the vicinity of the nozzles that will be used in the subsequent print operation, and in the second preliminary ejection operation, ink is also ejected from nozzles located in the vicinity of the nozzles that will be newly used in the subsequent print operation.

10. The ink jet printing apparatus of claim 1, wherein, in the case where the range of nozzles of the print head to be used in the subsequent print operation exceeds the range of nozzles of the print head used in the previous print operation, before the subsequent print operation, the preliminary ejection unit causes the print head to perform the first preliminary ejection operation in which ink is ejected from the nozzles to be used in the subsequent print operation after causing the print head to perform the second preliminary ejection operation.

11. The ink jet printing apparatus of claim 1, wherein, in the case where the range of nozzles of the print head to be used in the subsequent print operation exceeds that range of nozzles of the print head used in the previous print operation, the preliminary ejection unit causes the print head to perform the second preliminary ejection in which ink is ejected from the nozzles that will be newly used in the subsequent print operation while ink is not ejected from the nozzles used in the previous print operation.

12. The ink jet printing apparatus of claim 11, wherein, in the case where the range of nozzles of the print head to be used in the subsequent print operation exceeds the range of nozzles of the print head used in the previous print operation, before the subsequent print operation, the preliminary ejection unit causes the print head to perform the first preliminary ejection operation in which ink is ejected from the nozzles to be used in the subsequent print operation after causing the print head to perform the second preliminary ejection operation.

13. A recovery method for recovering an ejection function of a plurality of nozzles arrayed on a print head, comprising the steps of:

specifying a range of nozzles of the print head to be used in a subsequent print operation; and executing a preliminary ejection operation to the print head, the preliminary ejection operation including a first preliminary ejection operation and a second preliminary ejection operation, wherein in a case where the range of nozzles of the print head to be used in the subsequent print operation is included in a range of nozzles of the print head used in a previous print operation, the first preliminary ejection operation is executed by using nozzles which will be used in the subsequent print operation, and in a case where the range of nozzles of the print head to be used in the subsequent print operation exceeds the range of nozzles of the print head used in the previous print operation, the second preliminary ejection operation is executed by using nozzles which will be newly used in the subsequent print operation, the amount of the ink ejected from each of the nozzles in the second preliminary ejection operation being greater than the amount of the ink ejected from each of the nozzles in the first preliminary ejection operation.

14. The method of claim 13, further comprising the steps of:

detecting if the range of nozzles to be used in the subsequent print operation changed from the range of nozzles used in the previous print operation; and executing the first preliminary ejection operation or the second preliminary ejection operation in accordance with a detected result.

15. An ink jet printing apparatus comprising:

a conveying unit configured to convey a print medium in a first direction;

a print head having a plurality of nozzles for ejecting ink which are arrayed in a second direction intersecting with the first direction; and a preliminary ejection unit configured to cause the print head to eject ink from a plurality of nozzles so as to perform a preliminary ejection operation, wherein in a case where a range of nozzles of the print head to be used in a subsequent print operation is included in a range of nozzles of the print head used in a previous print operation, the preliminary ejection unit causes the print head to perform a first preliminary ejection operation in which ink is ejected from the nozzles to be used in the subsequent print operation, and in a case where the range of nozzles of the print head to be used in the subsequent print operation exceeds that range of nozzles of the print head used in the previous print operation, the preliminary ejection unit causes the print head to perform a second preliminary ejection in which ink is ejected from the nozzles that will be newly used in the subsequent print operation while ink is not ejected from the nozzles used in the previous print operation, and then causes the print head to perform the first preliminary ejection operation in which ink is ejected from the nozzles to be used in the subsequent print operation, before the subsequent print operation.

* * * * *